US008251805B2

(12) United States Patent
Englman et al.

(10) Patent No.: US 8,251,805 B2
(45) Date of Patent: Aug. 28, 2012

(54) GAMING SYSTEM HAVING IMPROVED PROGRESSIVE JACKPOTS

(75) Inventors: Allon G. Englman, Chicago, IL (US); Robert L. Kyte, Chicago, IL (US); Michael W. Mastropietro, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 358 days.

(21) Appl. No.: 12/672,977

(22) PCT Filed: Aug. 28, 2008

(86) PCT No.: PCT/US2008/010182

§ 371 (c)(1),
(2), (4) Date: Feb. 10, 2010

(87) PCT Pub. No.: WO2009/032150

PCT Pub. Date: Mar. 12, 2009

(65) Prior Publication Data

US 2011/0130191 A1 Jun. 2, 2011

Related U.S. Application Data

(60) Provisional application No. 60/966,570, filed on Aug. 29, 2007.

(51) Int. Cl.
*A63F 9/24* (2006.01)

(52) U.S. Cl. ..... 463/27; 463/16; 463/20; 463/25; 463/29

(58) Field of Classification Search ..... 463/16–20, 463/25–29

See application file for complete search history.

(56) References Cited

U.S. PATENT DOCUMENTS

| | | | | |
|---|---|---|---|---|
| 5,280,909 | A | 1/1994 | Tracey | 273/138 A |
| 6,416,409 | B1 | 7/2002 | Jordan | 463/27 |
| 6,835,134 | B2 | 12/2004 | Poole et al. | 463/25 |
| 7,662,040 | B2 | 2/2010 | Englman et al. | 463/42 |
| 7,780,531 | B2 | 8/2010 | Englman et al. | 463/42 |
| 7,874,915 | B2 | 1/2011 | Caspers et al. | 463/27 |
| 7,931,530 | B2 | 4/2011 | Anderson et al. | 463/20 |
| 2005/0054429 | A1 | 3/2005 | Baerlocher et al. | 463/25 |

(Continued)

FOREIGN PATENT DOCUMENTS

WO WO 2005/099425 10/2005

OTHER PUBLICATIONS

PCT International Search Report for International Application No. PCT/US2008/010182 dated Nov. 10, 2008 (2 pages).

(Continued)

*Primary Examiner* — Omkar Deodhar
(74) *Attorney, Agent, or Firm* — Nixon Peabody LLP

(57) ABSTRACT

A method of operating a wagering game comprises receiving a primary wager, displaying a randomly selected outcome of a primary wagering game, and displaying at least one progressive jackpot. A first portion of the primary wager is allocated to fund the at least one progressive jackpot. An increment amount to be added to the at least one progressive jackpot is randomly determined, the at least one progressive jackpot is incremented by the increment amount, and in response to a triggering event, the at least one progressive jackpot is awarded. Alternatively, a random determination is made whether to increase the at least one progressive jackpot by a predetermined increment amount and, in response to a determination to increase the at least one progressive jackpot, the at least one progressive jackpot is incremented by the predetermined increment amount.

18 Claims, 8 Drawing Sheets

U.S. PATENT DOCUMENTS

| | | | | |
|---|---|---|---|---|
| 2006/0135243 | A1 | 6/2006 | Englman et al. | 463/16 |
| 2008/0045341 | A1 | 2/2008 | Englman | 463/42 |
| 2009/0247277 | A1 | 10/2009 | Caspers et al. | 463/20 |
| 2009/0247292 | A1 | 10/2009 | Caspers et al. | 463/27 |
| 2010/0016060 | A1 | 1/2010 | Jaffe | 463/20 |
| 2010/0267442 | A1 | 10/2010 | Englman et al. | 463/20 |
| 2010/0304830 | A1 | 12/2010 | Englman et al. | 463/17 |
| 2011/0165938 | A1 | 7/2011 | Anderson et al. | 463/25 |
| 2011/0201410 | A1 | 8/2011 | Englman et al. | 463/25 |

OTHER PUBLICATIONS

PCT International Written Opinion for International Application No. PCT/US2008/010182 dated Nov. 10, 2008 (5 pages).

500

502 504

| Weighting | Free Spins Increment Amount |
|---|---|
| 9 | 0 |
| 1 | 1 |

FIG. 5

GAMING SYSTEM HAVING IMPROVED PROGRESSIVE JACKPOTS

CROSS REFERENCE TO RELATED APPLICATIONS

This application is a U.S. national stage of International Application No. PCT/US2008/010182, titled "Gaming System Having Improved Progressive Jackpots" and filed Aug. 28, 2008, which claims priority to U.S. Provisional Patent Application Ser. No. 60/966,570, titled "Gaming System Having Improved Progressive Jackpots" and filed on Aug. 29, 2007, each of which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having passive player participation in secondary wagering games.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming systems with new types of bonus games to satisfy the demands of players and operators.

SUMMARY OF THE INVENTION

According to one aspect of the present invention, a method of operating a wagering game comprises receiving a primary wager, displaying a randomly selected outcome of a primary wagering game, and displaying at least one progressive jackpot. The method further comprises allocating a first portion of the primary wager to fund the at least one progressive jackpot, randomly determining an increment amount to be added to the at least one progressive jackpot, incrementing the at least one progressive jackpot by the increment amount, and in response to a triggering event, awarding the at least one progressive jackpot.

According to another aspect of the invention, a method of operating a wagering game comprises receiving a primary wager from a player, updating an eligibility counter for the player by adding a first time amount to the counter, the eligibility counter decreasing over time at a deterioration rate, and displaying a randomly selected outcome of a primary wagering game. The method further comprises displaying at least one progressive jackpot and incrementing the at least one progressive jackpot by an increment rate, the increment rate comprising a first increment amount every X seconds, wherein the increment rate is a function of the deterioration rate. The method further comprises, in response to a triggering event, awarding the at least one progressive jackpot.

According to yet another aspect of the invention, a gaming system comprises a first display for displaying a first wagering game in response to receiving a first wager input and a first controller operative to increment eligibility time to a first counter of bonus-time eligibility in response to receiving the first wager input, decrement the first counter as real time progresses, and if the first counter is greater than zero when a first triggering event occurs, provide a first bonus event associated with the first wagering game. The system further comprises a second display for displaying a second wagering game in response to receiving a second wager input and a second controller operative to increment eligibility time to a second counter of bonus-time eligibility in response to receiving the second wager input, decrement the second counter as real time progresses, and if the second counter is greater than zero when a second triggering event occurs, provide a second bonus event associated with the second wagering game. The first and second triggering events are independent of one another.

According to still another embodiment, a method of operating a wagering game is disclosed. The method comprises receiving a primary wager to play a primary wagering game and displaying at least one progressive jackpot associated with the primary wagering game. The method further comprises allocating a first portion of the primary wager to fund the at least one progressive jackpot. The method further comprises randomly determining whether to increase the at least one progressive jackpot by a predetermined increment amount and, in response to a determination to increase the at least one progressive jackpot, incrementing the at least one progressive jackpot by the predetermined increment amount.

According to yet another aspect of the invention, a computer readable storage medium is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 5 is a weighted table utilized in incrementing the one or more improved progressive jackpots of FIG. 4;

DETAILED DESCRIPTION

Figure 1A:
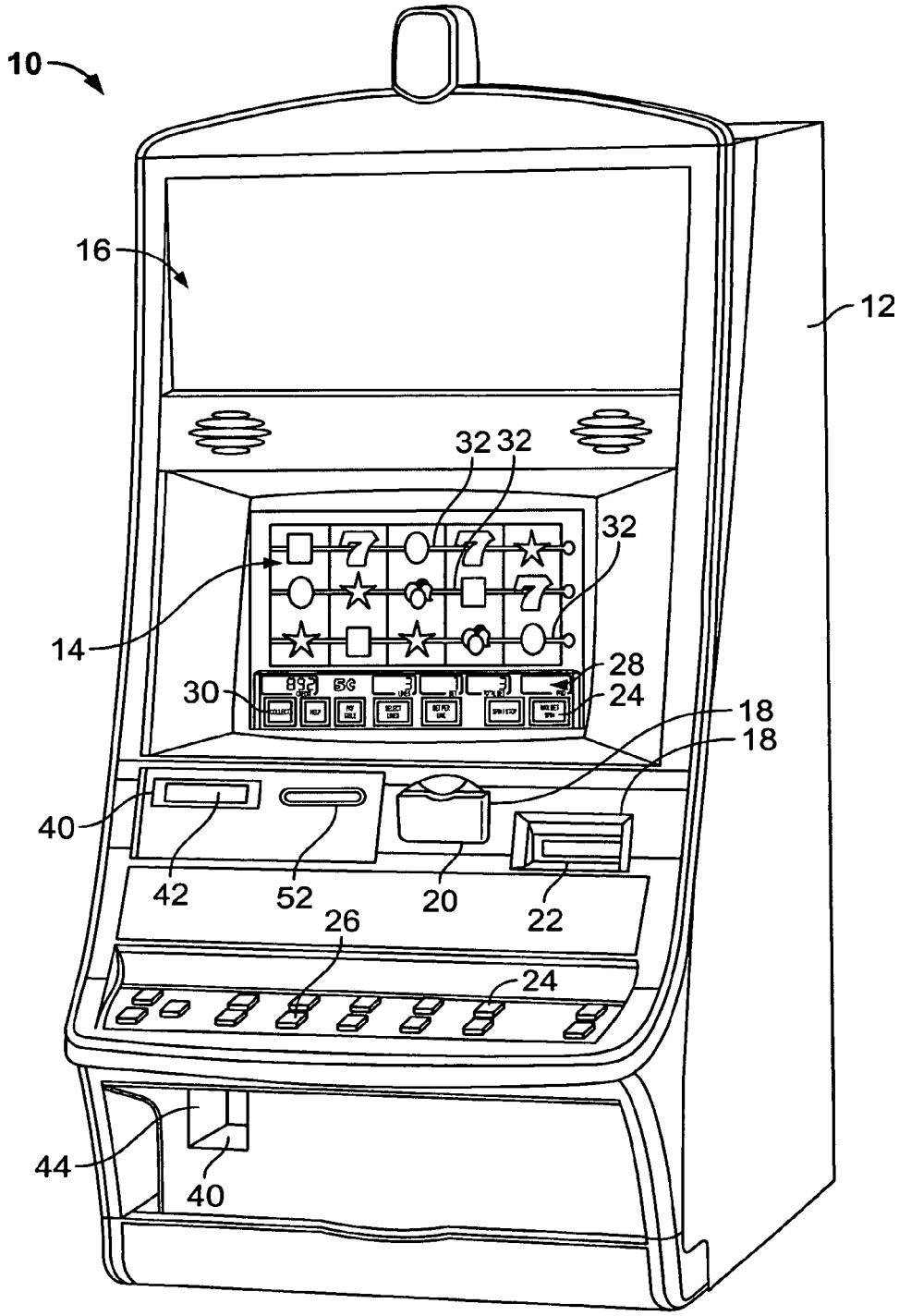
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, any other game compatible with a display comprising at least one symbol-bearing reel strip. The gaming machine 10 may also be a hybrid gaming machine integrating both electronic and electromechanical displays.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 of the gaming machine 10 may include a number of mechanical reels to display the outcome in visual association with at least one payline 32. Alternatively, the primary display 14 may take the form of a hybrid display incorporating both electromechanical display components, such as reels, with an electronic display, which may include a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
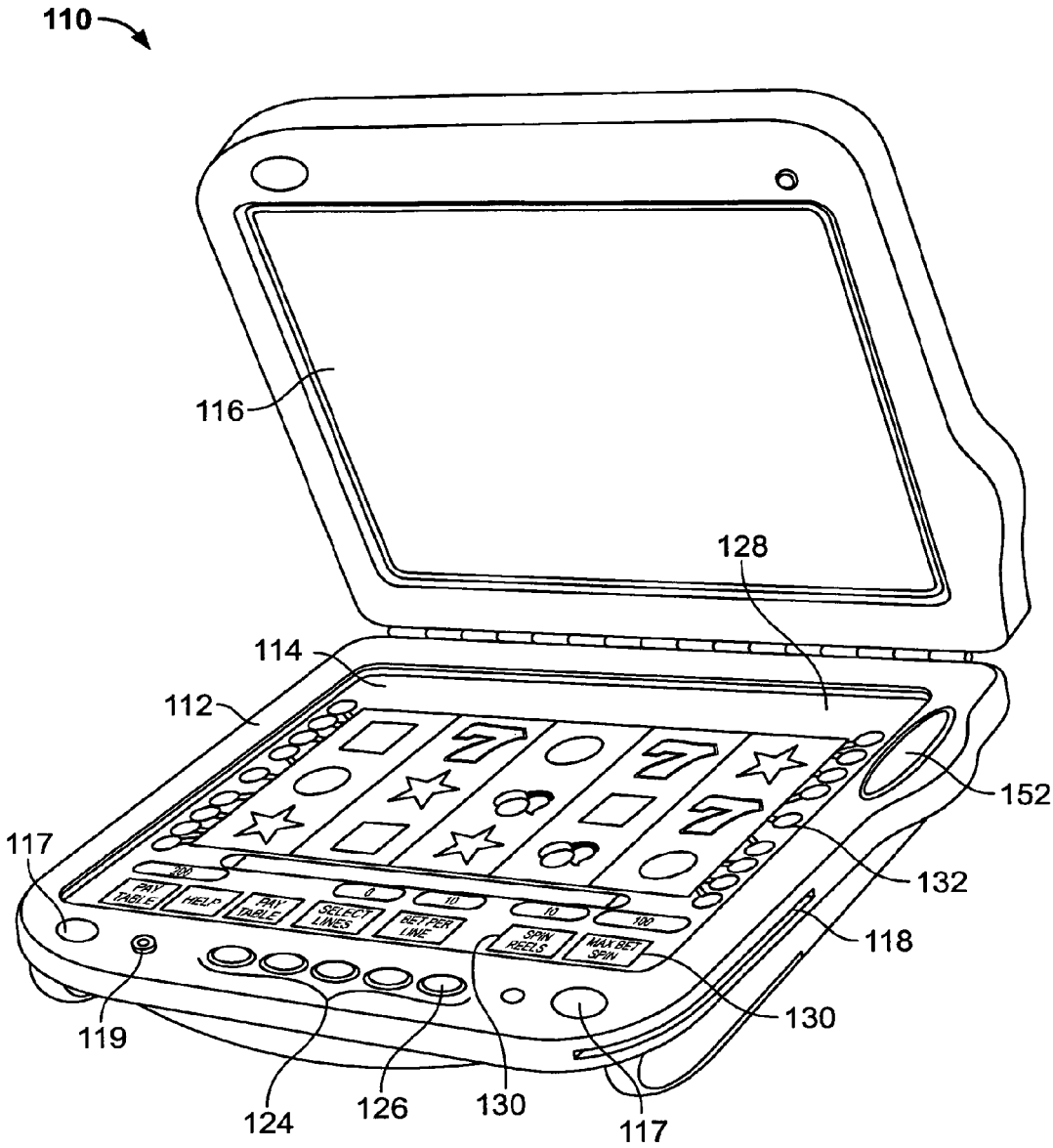
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electromechanical gaming machine configured to play mechanical slots, any other game compatible with a display comprising at least one symbol-bearing reel strip. The handheld gaming machine 110 may also be a hybrid gaming machine integrating both electronic and electromechanical displays. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably includes a number of mechanical reels to display the outcome in visual association with at least one payline. Alternatively, the primary display 114 may take the form of a hybrid display incorporating both electromechanical display components, such as reels, with an electronic display, which may include a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 118 or an assignment of credits stored on the handheld gaming machine via the player input device 124, e.g. the touch screen keys 130 or push buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
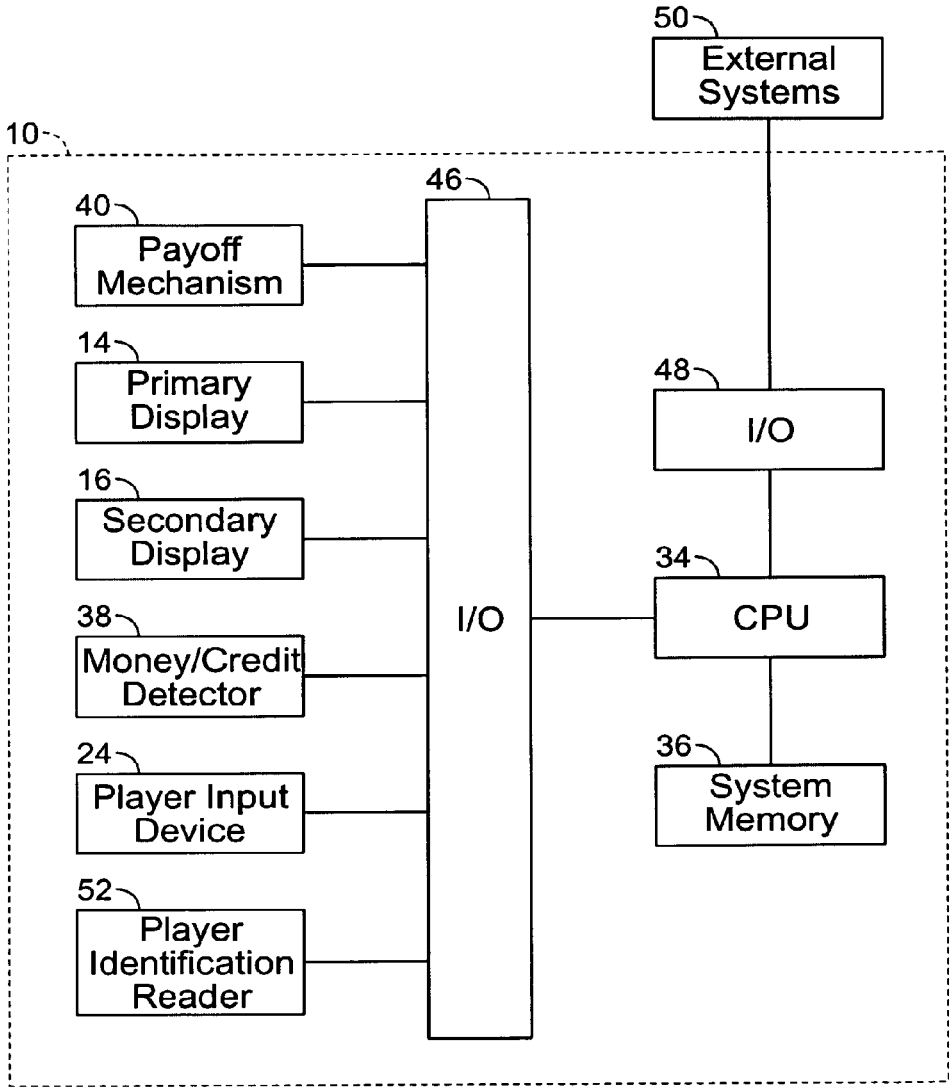
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
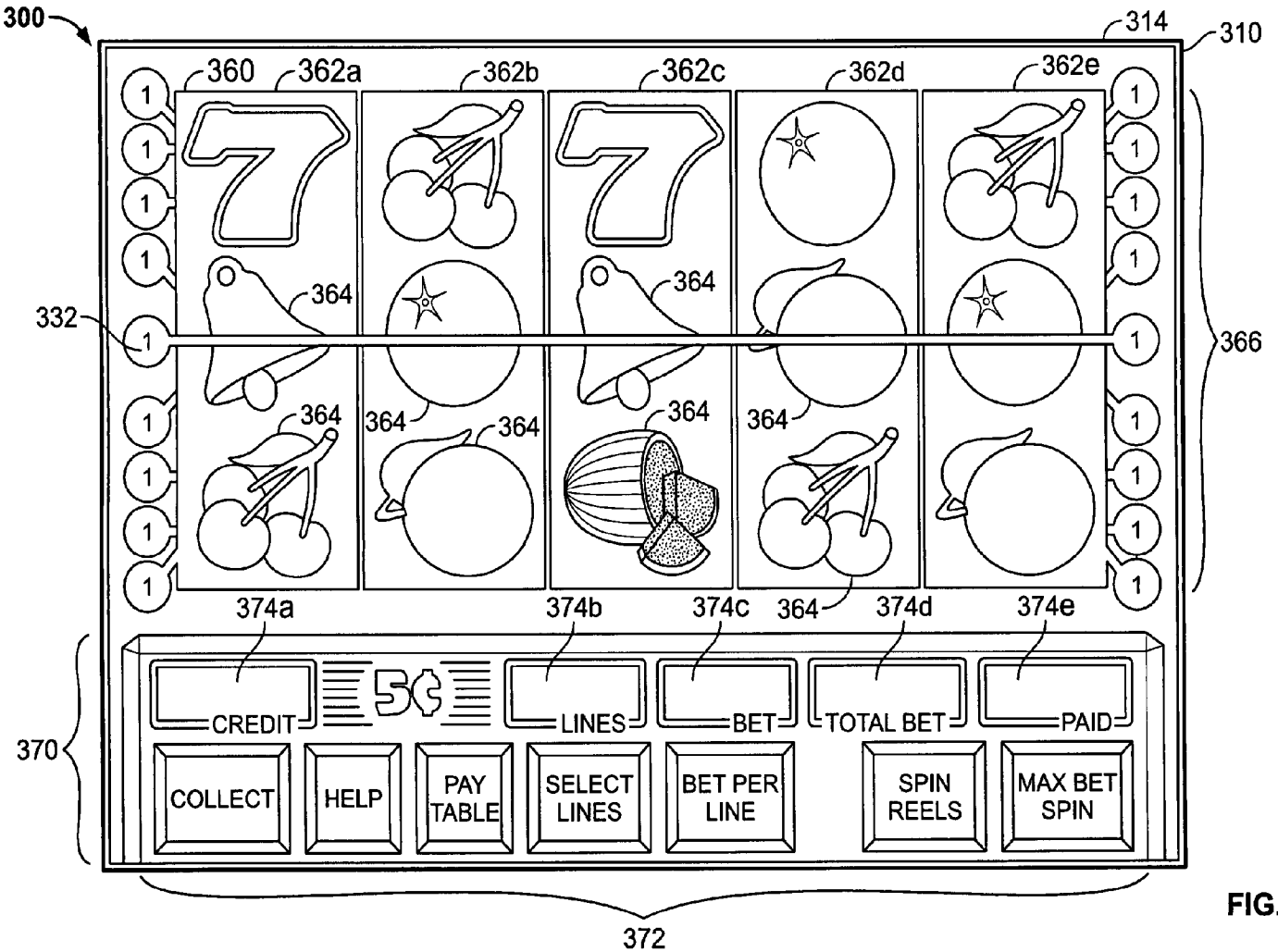
FIG. 3 is a screen shot of a primary wagering game of a gaming system.

Turning now to FIG. 3, a primary display 314 of a gaming device 310 of a gaming system 300 is shown. The primary display 314 may be any form of display such as those described herein with reference to the free standing and handheld gaming devices of FIGS. 1*a* and 1*b*. The primary display 314 includes display of a primary wagering game 360, which in this embodiment is a slot game as shown in FIG. 3. The slot game 360 includes a plurality of reels 362*a,b,c,d,e* which may be either electro-mechanical reels or simulations thereof on the primary display 314. The reels 362*a,b,c,d,e* include a plurality of symbols 364 displayed thereon which vary as the reels 362*a,b,c,d,e* are spun and stopped. The symbols 364 may include any variety of graphical symbols, elements, or representations, including symbols 364 which are associated with one or more themes of the gaming machine or system. The symbols 364 may also include a blank symbol or empty space. As described herein, the symbols 364 landing on the active paylines 332 (the paylines for which a wager has been received) are evaluated for winning combinations. If a winning combination of symbols 364 lands on an active payline 332, a primary award is awarded in accordance with a pay table of the gaming device. The symbols 364 on the reels 362*a,b,c,d,e* form an array 366 or matrix of symbols 364, having a number of rows and columns, which in the embodiment shown is four rows and five columns. In alternate embodiments, the array 366 may have greater or fewer symbols 364, and may take on a variety of different forms having greater or fewer rows and/or columns. The array 366 may even comprise other non-rectangular forms or arrangements of symbols 364.

A control bar 370 appears along the bottom of the display 314 and includes a plurality of input buttons or keys 372 for which inputs are sensed by a touch screen overlying the display 314. Moreover, a plurality of meters 374 are displayed on the control bar 370, including a Credit Meter 374*a*, a Lines Meter 374*b*, a Bet Meter 374*c*, a Total Bet Meter 374*d*, and a Paid Meter 374*e*. The Credit Meter 374*a* displays the number of credits available to a player based upon coin, currency or other value input into the system 300. The Lines Meter 374*b* displays the number of paylines 332 which the player has activated for play. The Bet Meter 374*c* displays the size of the wager that the player is placing (the bet amount in credits) on each activated payline. The Total Bet Meter 374*d* displays the total wager on a single play of the wagering game 360, which is the product of the bet amount in the Bet Meter 374*c* and the number of activated paylines in the Lines Meter 374*b*. The Paid Meter 374*e* displays how many credits, if any, have been awarded to the player as a result of a winning outcome on a single play of the primary wagering game 360. If a winning outcome is achieved, the Paid Meter 374*e* displays the size of the win in credits, after which the credits are transferred to the player's balance in the Credit Meter 374*a*, and the Paid Meter 374*e* is reset to zero for a subsequent play of the primary wagering game 360.

Figure 4:
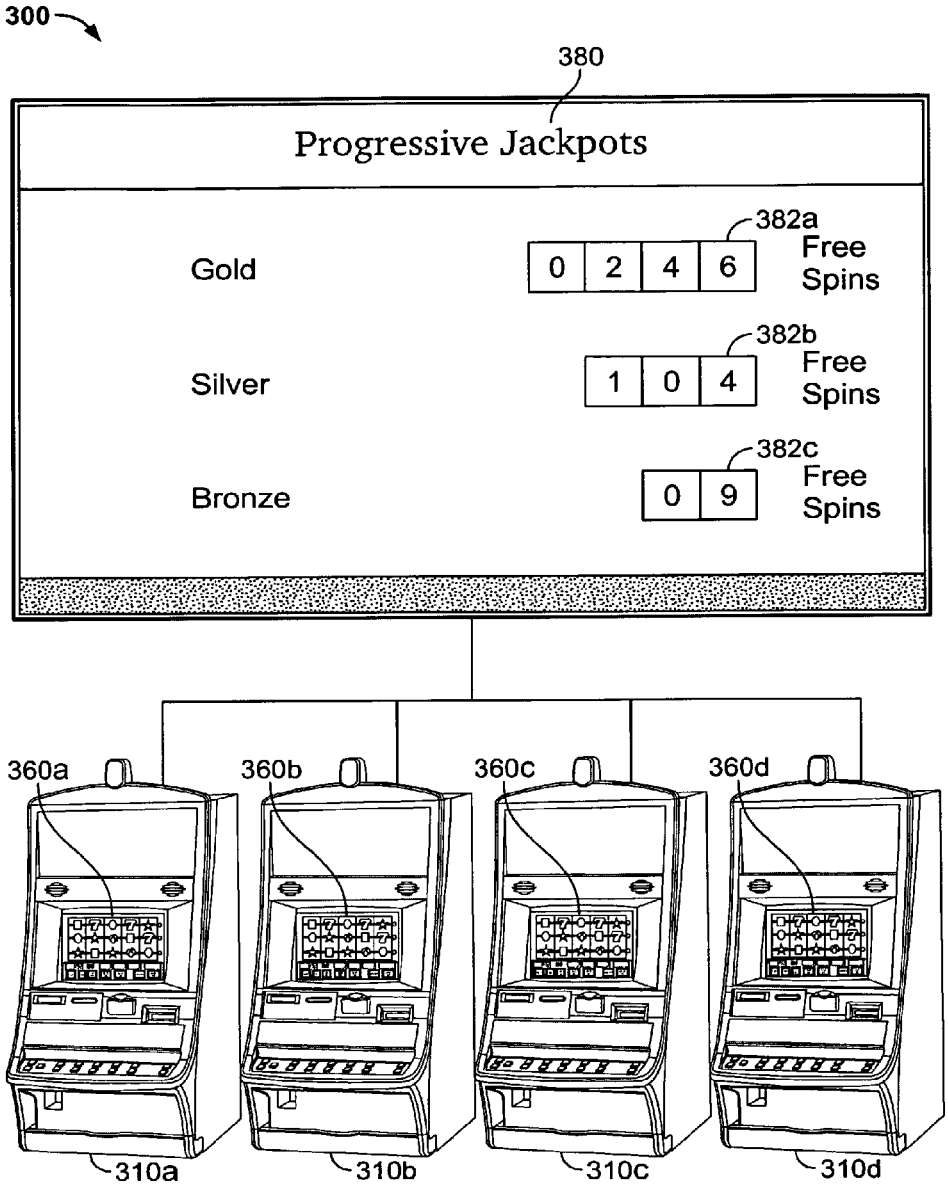
FIG. 4 is a diagram of gaming system including one or more improved progressive jackpots.

Turning to FIG. 4, an alternative view of the gaming system 300 is displayed in which a secondary display 380, such as a plasma display, is mounted above one or more gaming devices 310*a-d* in a casino. The secondary display 380 is in communication with other components of the system 300 such as the various gaming devices 310*a-d*. The secondary display 380 displays one or more progressive jackpots 382*a,b,c*, which in this embodiment are the "Gold", "Silver," and "Bronze" progressive jackpots. The progressive jackpots 382 are available to be awarded to eligible players of one or more primary wagering games 360*a-d* on the gaming devices 310*a-d*, upon the occurrence of one or more triggering events. In an embodiment, a triggering event which causes the award of one or more of the progressive jackpots 380 is a particular outcome in a primary wagering game 360. For example, three or more "Bonus" symbols aligning on an activate payline in a primary wagering game 360 may trigger one or more of the progressive jackpots. In alternative embodiments, other triggering events may be utilized. For example, triggering events may include time-based triggers where a progressive jackpot 382 is awarded after a certain amount of time has elapsed. Moreover, the trigger may be a randomly selected event, such that the progressive jackpots 382 are randomly awarded. In yet other embodiments, triggering events may include a threshold time playing a primary wagering game 360 (time on device), total wagers input meeting a predetermined amount (coin in), accumulation of a certain amount of credits, points, or assets, etc.

In the embodiment shown in FIG. 4, the progressive jackpots 382 are an accumulation of "free spins" of the underlying primary wagering games 360*a-d*. Thus, if a triggering event occurs and a particular progressive jackpot 382 is awarded to a player, the player receives a number of free spins of the primary wagering game 360 equal to the balance of the progressive jackpot awarded. Thus, in FIG. 4, if a triggering event awards the Gold Level progressive to a player, he would receive 246 free spins as indicated by the meters on the secondary display 380. Free spins being stored and awarded through progressive jackpots may be accomplished in various ways, including the methods described in international patent application WO 2005/099425, assigned to WMS Gaming Inc., which is incorporated herein by reference in its entirety as if fully set forth herein. In one method, an expected value of the primary wagering game 360 is utilized in determining the frequency with which one or more of the progressive jackpots 382 are triggered, and the size of the jackpots 382 awarded (the number of free spins provided).

The present invention utilizes a random determination process to increment the progressive jackpots 382 displayed on the secondary display 380. This random determination process ensures that only whole numbers of free spins are displayed, rather than fractional free spin awards. Thus, the system 300 of the present invention utilizes a random number generator to increment the progressive jackpots 382. The display of the progressive jackpots 382 is incremented (if at all) through a determination made from a weighted probability table, an example of which is depicted in FIG. 5.

The random determination is made in accordance with the weighted table 500 shown in FIG. 5, which determines whether or not to increment the progressive jackpot meters 382. The table includes a weighting column 502 and a corresponding free spin increment column 504. Thus, in the embodiment shown, a random number is selected between 1 and 10. If the number selected is 1 through 9, then the progressive jackpots are incremented by an amount of "zero" (i.e., they are not incremented). If 10 is selected, then one or more of the progressive jackpots 382 are incremented by the corresponding 1 free spin. In an embodiment, a random determination is made for each level of the progressive jackpots 382. Thus, on each play of the wagering game 360 (each time a primary wager is input), there is a 90% chance that the progressive meters will not be incremented, and a 10% chance that the progressive meters will be incremented by a whole number amount (1 free spin, for example). This way, the incrementing of the progressive meters avoids fractional or decimal incrementing of the progressive meters. In other embodiments, other weighted tables other than the one shown in FIG. 5 may be used. As can be seen from this configuration, on average, once every 10 spins of the primary wagering game 360, the meters 382 will be incremented by one (1) spin.

In an embodiment, instead of a portion of each primary wager being added to the progressive meters, a larger portion of the primary wager which triggers an incrementing of the progressive meters 382 is taken. For example, in one embodiment the progressive jackpots 382 are configured to be funded by 5% of the primary wagers input into the system 300. In a traditional system, for each $1.00 wagered, $0.05 would be added to the meters on each press of the spin button. In the system 300, according to an embodiment of the present invention, whether or not any portion of the primary wager is added to the progressive jackpots 382 is a function of the random determination made in accordance with the weighted table 500, such as the one in FIG. 5. If the result of the random determination is that the increment amount is zero (the progressive meter will not be incremented), then none of the $1.00 primary wager is apportioned for the progressive jackpots 382, nor are the progressive jackpots 382 incremented. On the other hand, if the result of the random determination is that the meters 382 are to be incremented by one (1) spin, then $0.50 of the primary wager on that spin is apportioned to the progressive meters 382. The apportioned amount ($0.50) of the primary wager is calculated as follows:

$$\text{Apportioned Amount} = \frac{\text{Primary Wager} \times \text{Progressive Portion}}{\text{Increment Odds}}$$

Thus, the total amount to be apportioned to the progressive jackpots 382 is a function of the amount of the primary wager ($1.00, in the example), the portion of the primary wager allocated to the progressive jackpots (5%, in the example), and the odds of the progressive meters 382 being incremented in accordance with the weighted table such as the one in FIG. 5 (10%, in the example). Thus, for the example shown, where the progressive jackpots 382 are configured to have a 5% allocation of primary wagers, and the odds of the increment occurring are 10%, the apportioned amount is calculated as follows:

$$\text{Apportioned Amount} = \frac{(\$1.00) \times (0.05)}{(0.10)} = \$0.50$$

Thus, with such an embodiment, the meters 382 are incremented on average once every 10 spins, and when they are incremented, an apportioned amount of $0.50 is added to the meters 382 (based upon primary wagers of $1.00). In this way, instead of 5% of a primary wager being added to the meters on every spin (as would be done with traditional progressive systems), 50% of a primary wager is added every ten spins on average.

In an alternative embodiment, a progressive-increment pool is utilized to receive and store portions of wagers attributable, and used, to increment the progressive jackpots 382. Thus, for each play of a primary wagering game 360 of the system 300, a portion of the primary wager is allocated to a progressive-increment pool. Thus, using the numbers from the example above, five percent (5%) of all primary wagers are apportioned and stored in a progressive-increment pool. On a $1.00 wager, $0.05 is stored in the progressive-increment pool. As before, on each spin a random determination is executed to determine whether an increment amount (if any) should be applied to the progressive jackpot meters 382, in accordance with a weighted table 500 (for example the table in FIG. 5). On average, ten spins will occur before a progressive jackpot 382 is incremented, correlating to an average of ten $0.05 apportionments being collected into the progressive-increment pool (or $0.50 being collected into the progressive-increment pool). When the random determination results in one or more progressive meters being incremented, the amount added to the meters is removed from the progressive-increment pool and placed into a progressive pool. When a progressive jackpot 382 is awarded in response to a triggering event, then a corresponding award (jackpot) is provided from the progressive pool (which has been repeatedly funded from by the progressive-increment pool. In this way, the progressive-increment pool increases with every spin, but is decremented only when a random determination indicates that the progressive meters should be incremented. If the progressive jackpots are free spins, as discussed herein, the progressive-increment pool can be decremented by an amount sufficient to compensate for the expected value of the free spins incremented to the progressive jackpot 382, as explained further herein.

The progressive increment pool may be a single pool or may be subdivided into various accounts or funds corresponding to the various progressive jackpots 382. In an embodiment, a fixed percentage of each primary wager is deducted and allocated to the progressive increment pool (e.g., 5% of all primary wagers). In alternative embodiments, the portion of primary wagers deducted may be a fixed amount ($0.01), a fixed credit amount (10 credits), or determined randomly or in accordance with some formula, table, or algorithm. The progressive increment pool is used to fund the progressive jackpots 382 so that they contain available prizes to be awarded, as described herein.

When a triggering event occurs, one or more of the progressive jackpots 382 is awarded to a player, as described herein. For example, if three "Gold" symbols in the primary wagering game 360 are aligned on an active payline, a player is awarded the Gold level jackpot, which in the example shown in FIG. 4 is 246 spins. Thus, the player would receive 246 free spins (or plays) of the primary wagering game 360 displayed on the gaming device 310 he is playing. Any awards accumulated during those free spins would be awarded to the player and credited to his win meter. In one embodiment, the free spins have been financed by the apportioned amounts, which have been collected and applied to the progressive meters 382. In another embodiment, the free spins are paid for, or financed, by the progressive increment pool. Thus, according to a configuration of the primary wagering game 360, each play of the primary wagering game 360 has an expected award value (based upon the size of the initial wager). The expected progressive-award value to the player for the awarded free spins can be calculated as a function of the number of free spins awarded and the expected value of each free spin. This expected progressive-award value can then be decremented from the progressive increment pool. Thus, when a free spin progressive jackpot 382 is awarded, the progressive increment pool is decremented in an amount sufficient to finance the number of free spins awarded. Other techniques may be used to decrement the progressive increment pool in an appropriate amount for the free-spin award provided.

It should also be understood that the increment method described herein may give the appearance of "jumps" or sudden increases in the progressive meters 382. Traditional progressive jackpot incrementing techniques that use decimals and small portions give the appearance of constantly being incremented due to the constant addition of small portions of each wager to the progressive jackpots. The present invention provides a different experience in that the progressive meters will "jump" when the whole number award is randomly awarded, whereas on many plays of the wagering game, the progressive meters will not move at all (corresponding to the zero award being awarded). Thus, an observer of the progressive meters will see spurts, jumps, and bursts of increases of the balances of the jackpots shown in the progressive meters, rather than a smooth and steady increase of fractional amounts.

Figure 6:
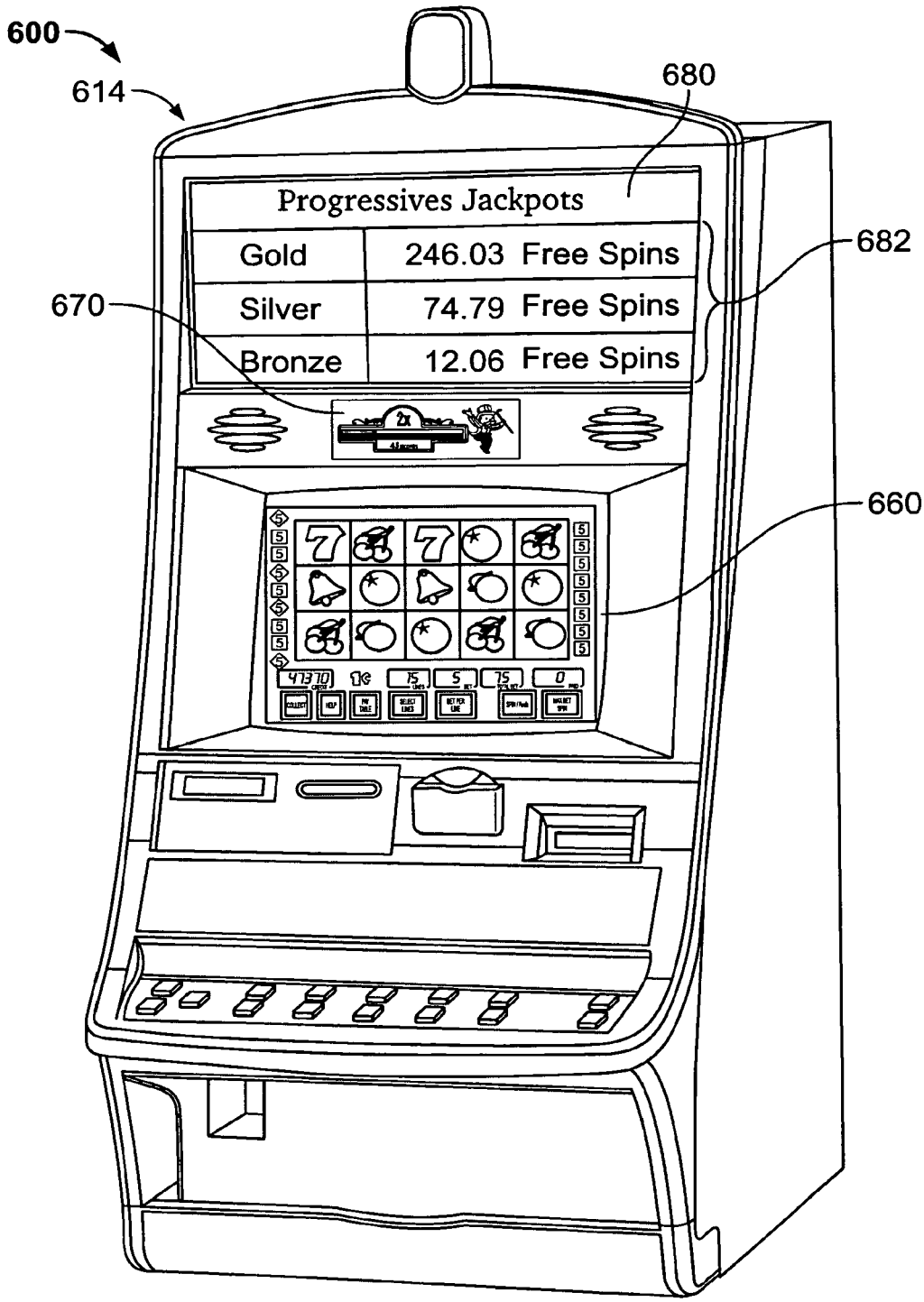
FIG. 6 is a diagram of an alternative embodiment of a gaming system including improved progressive jackpots.

An alternative embodiment of the invention is shown in FIG. 6, wherein a gaming device 614 displays a primary wagering game 660 which includes a time eligibility meter 670, as described in PCT Patent Publication WO 2006/121663, and U.S. Published Patent Application 2006/0135243, both of which are assigned to WMS Gaming Inc., and incorporated herein by reference in their entirety as if full set forth herein. During each play of the wagering game 660, the time eligibility meter 670 is increased in amount corresponding to and dependent upon (i) the size of the primary wager, (ii) the rate of play of the primary wagering game, or both. The time eligibility meter 670 may include a plurality of multiplier levels such that the meter 670 displays both a running time meter clock and a current multiplier level. Moreover, as time eligibility is accumulated in the meter 670, the multiplier levels may increase, and as time eligibility is expended through decrementing of the meter 670, the multiplier levels may decrease, as described therein. The gaming device 614 further includes one or more progressive meters 682 displayed on a secondary display 680 of the gaming device 614. In this embodiment, the progressive meters 682 are incremented as the time eligibility meter 670 decreases or decays. Thus, the incrementing of the progressive jackpots 682 is a function of the decay of the time eligibility meter 670 rather than a portion or function of the primary wager amount.

During play, a fixed amount of time is added to the time eligibility meter 670 for each spin or activation of the primary wagering game 660. For example, the time interval added to the meter 670 may be 7 seconds for each spin. In an embodiment, for each second of decay of the time eligibility counter 670, a base increment amount is added to one or more of the progressive jackpots 682. For example, the wagering game 660 may be configured so that every second of decay of the time eligibility counter 670, 0.01 free spins are added to each of the progressive meters 682. Thus, after 100 seconds of decay of the time eligibility meter 670, one (1) free spin will be incremented to the progressive meters 682.

In an alternative embodiment, the progressive jackpots 682 are incremented less frequently by a larger amount. For example, the jackpots 682 may be incremented by an amount less than or equal to the base increment amount multiplied by the time interval, but such incrementing occurs after the decay of an amount of time equal to the time interval. Thus, in the example described herein, the increment amount is less than or equal to the base increment amount (0.01 free spins) times the time interval (7 seconds), or 0.07 free spins. However, the incrementing occurs only after the time meter 670 decays by an amount equal to the time interval (7 seconds). Thus, for each seven (7) seconds decremented off the time meter 670, the progressive meters 682 are incremented by an amount less than or equal to 0.07 free spins. The examples differ in presentation such that in one example, the meters are incremented 0.01 spins every second, and in the other example the meters are incremented 0.07 spins every seven (7) seconds. In this way, the incrementing of the progressive jackpots 382 is a function of the decay of the time eligibility meter 670.

Figure 7:
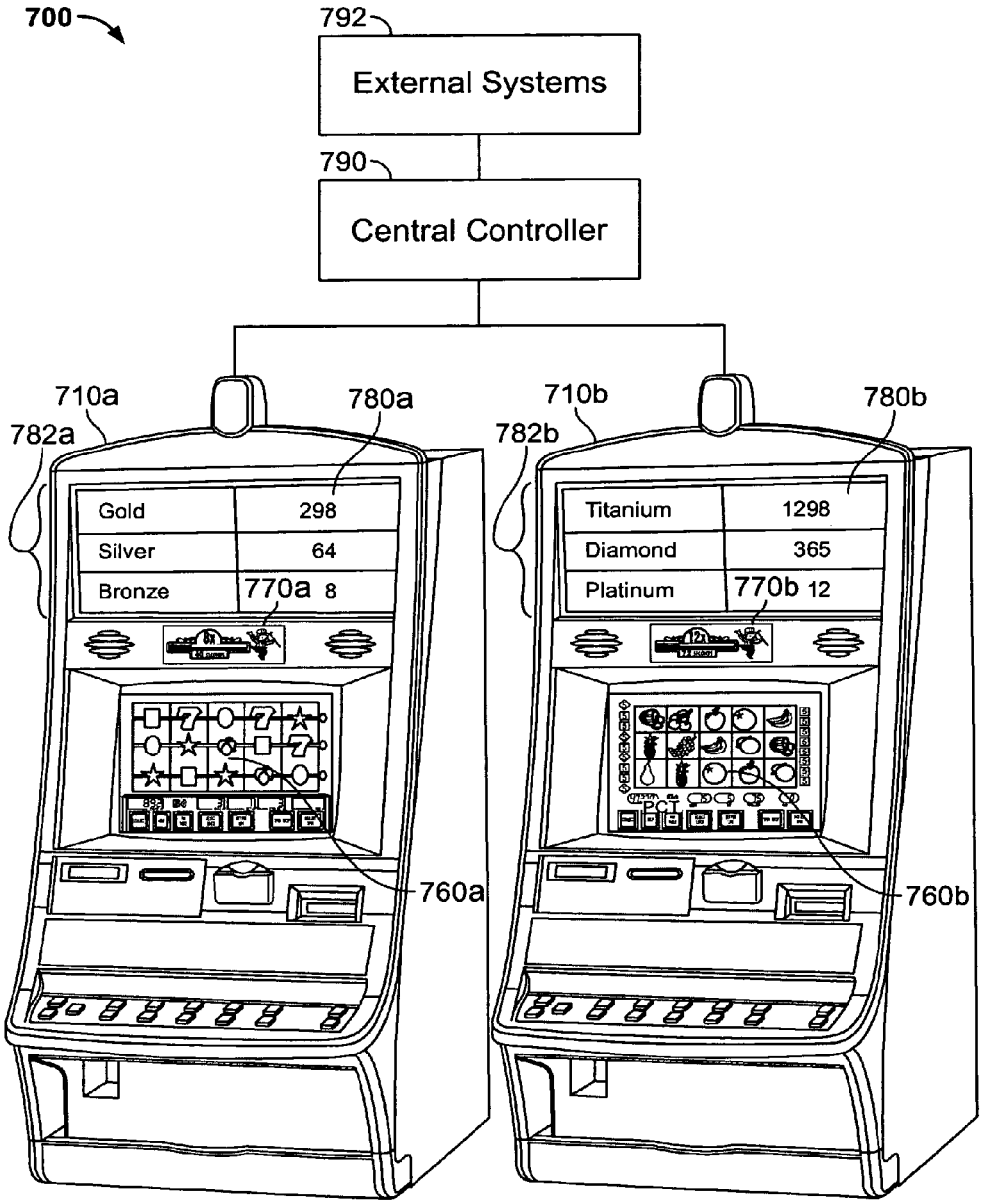
FIG. 7 is a diagram of yet another alternative embodiment of a gaming system including improved progressive jackpots.

Another embodiment of a gaming system 700 is displayed in FIG. 7. In such embodiments, the system comprises a plurality of gaming devices 710*a,b*, such as the free standing and/or handheld gaming devices described herein with reference to FIGS. 1*a* and 1*b*. Each gaming device has its own controller (not shown) which operates an individual time eligibility counter 770*a,b* for such gaming device 710*a,b*. The time eligibility counters 710*a,b* include multiplier levels, and are incremented during play of the primary wagering game. Thus, as a lower level of time eligibility is filled, the multiplier level is increased, and time eligibility on a higher level begins to be incremented during play of the wagering game. Each gaming device 710*a,b* displays a primary wagering game 760*a,b*, as described herein. Moreover the system 700 may include a central controller 790 and external systems 792 in communication with the gaming devices 710*a,b*. The central controller 790 may serve to process requests and exchanges of information between and among the gaming devices 710*a,b*, and the external systems 792. The external systems 792 may include servers, network devices, memory storage, accounting components, peripherals, and other devices.

During operation of the system 700, the two gaming devices 710*a,b* operate independently. Thus, the first gaming device 710*a* includes its own controller (not shown) which operates the primary wagering game 760*a* displayed thereon, as well as the time eligibility meter 770*a* and the progressive jackpots 782*a*. Similarly, the second gaming device 710*b* includes its own controller (not shown) which operates the primary wagering game 760*b* displayed thereon, as well as the time eligibility meter 770*b* and the progressive jackpots 782*b* displayed thereon. Because the devices 710*a,b* are independent, the time eligibility meters 770*a,b* operate independently, and are incremented and decremented at different times based upon event occurring on the individual devices 710*a,b*. Similarly, the progressive jackpots 782*a* on the first device 710*a* are different than those on the second device 710*b*, and may be of different sizes, increment speeds, labels, themes, types, etc.

Each gaming device 710 operates individually to decrement its time eligibility meter 770. As each time eligibility meter 770 is decremented, one or more associated progressive jackpots 782 on that device 710 are incremented, as described herein with reference to FIG. 6. Thus, for example, for each ten seconds of decrementing of the time eligibility meter 770*a* on the first device 710*a*, one free spin is added to the progressive meters 782*a* on that device 710*a*. Similarly, for every twenty seconds of decrementing of the time eligibility meter 770*b* on the second device 710*b*, one free spin is added to the progressive meters 782*b* on that device 710*b*. As with the system of FIG. 6, a triggering event may cause an award of one or more of the progressive jackpots 782 on one or more of the devices 710*a,b* of the system. Jackpots 782*a,b* on separate devices 710*a,b* may be awarded simultaneously, separately, independently, or in any order or dependency. In this way, each device 710*a,b* operates independently to add time eligibility to the meters 770*a,b* based upon rate of play and size of wagers, decrement the meters 770*a,b* as time progresses, increment the progressive jackpots 782*a,b* based upon decay of the time eligibility meters 770*a,b*, randomly trigger a progressive jackpot 782*a,b* to be awarded, determine if a player of the associated gaming device 710*a,b* is eligible to receive the triggered jackpot 782*a,b*. If so, then the jackpot 782*a,b* triggered is awarded to such player.

As seen in FIG. 7, the time eligibility meters 770*a,b* of the two gaming devices 710*a,b* contain different balances. The first meter 770*a* has 40 seconds of eligibility at an 8× multiplier remaining. The second meter 770*b* has 72 seconds of eligibility at a 12× multiplier remaining. Moreover, the meters 770*a,b* are incremented at different rates, as indicated herein. In an embodiment, the meters 770*a,b* may be decremented at the same rate, or at different rates. However, it should be understood that each meter 770*a* serves its associated gaming device 710*a,b* and primary wagering game 770*a,b* independent of other gaming machines and devices on the system 700. In this way, each device 710*a,b* operates independently to increment and decrement the time eligibility meter 770*a,b*, increment the progressive jackpots 782*a,b* associated with the device 710*a,b*, and trigger jackpot awards.

The systems and methods described herein offer a number of benefits and advantages over traditional gaming systems. By utilizing a random determination process as described herein, progressive jackpots may be incremented using only whole numbers, and creating an exciting anticipation as to whether or not progressive meters will increment on each play of the game. Furthermore, a decay or decrementing of a time eligibility meter may be utilized to increment one or more progressive jackpots of a gaming system to provide additional excitement and anticipation. For example, a player may watch as progressive meters increment even though he or she is not actively playing a primary wagering game, but rather just through decay of a time eligibility meter. Moreover, the systems described herein permit a freestanding gaming device to operate independently to provide one or more progressive meters which are incremented and awarded independently of other gaming devices.

Each of these embodiments and obvious variations thereof is contemplated as falling within the spirit and scope of the claimed invention, which is set forth in the following claims.

What is claimed is:

1. A method of operating a wagering game comprising:

receiving a primary wager from a player via at least one input device;

updating, by at least one of one or more processors, an eligibility counter for the player by adding a first time amount to the counter, the eligibility counter decreasing over time at a deterioration rate;

displaying on at least one display device a randomly selected outcome of a primary wagering game;

displaying on the at least one display device at least one progressive jackpot;

incrementing, by at least one of the one or more processors, the at least one progressive jackpot by an increment rate, the increment rate comprising a first increment amount every X seconds, wherein the increment rate is a function of the deterioration rate; and in response to a triggering event, awarding, by at least one of the one or more processors, the at least one progressive jackpot.

2. The method of claim 1, wherein the eligibility counter is decremented by a first decrement amount each second and the at least one progressive jackpot is incremented by the first increment amount each second.

3. The method of claim 1, wherein the at least one progressive jackpot comprises an award of a number of free spins.

4. The method of claim 3, wherein the first increment amount comprises a fraction of a free spin.

5. The method of claim 1, wherein the first time amount equals N seconds.

6. The method of claim 5, wherein X is less than or equal to N.

7. A gaming system comprising:

at least one input device;

at least one display device;

at least one processor;

at least one memory device storing instructions that, when executed by the at least one processor, cause the gaming system to:

receive a primary wager from a player;

update an eligibility counter for the player by adding a first time amount to the counter, the eligibility counter decreasing over time at a deterioration rate;

display on the at least one display device a randomly selected outcome of a primary wagering game;

display on the at least one display device at least one progressive jackpot;

increment the at least one progressive jackpot by an increment rate, the increment rate comprising a first increment amount every X seconds, wherein the increment rate is a function of the deterioration rate; and in response to a triggering event, award the at least one progressive jackpot.

8. The gaming system of claim 7, wherein the eligibility counter decrements by a first decrement amount each second and the at least one progressive jackpot increments by the first increment amount each second.

9. The gaming system of claim 7, wherein the at least one progressive jackpot includes an award of a number of free spins.

10. The gaming system of claim 9, wherein the first increment amount includes a fraction of a free spin.

11. The gaming system of claim 7, wherein the first time amount equals N seconds.

12. The gaming system of claim 11, wherein X is less than or equal to N.

13. One or more machine-readable non-transitory storage media including instructions which, when executed by one or more processors, cause the one or more processors to perform operations comprising:

receiving a primary wager from a player;

updating an eligibility counter for the player by adding a first time amount to the counter, the eligibility counter decreasing over time at a deterioration rate;

displaying a randomly selected outcome of a primary wagering game;

displaying at least one progressive jackpot;

incrementing the at least one progressive jackpot by an increment rate, the increment rate comprising a first increment amount every X seconds, wherein the increment rate is a function of the deterioration rate; and in response to a triggering event, awarding the at least one progressive jackpot.

14. The machine-readable non-transitory storage media of claim 13, wherein the eligibility counter is decremented by a first decrement amount each second and the at least one progressive jackpot is incremented by the first increment amount each second.

15. The machine-readable non-transitory storage media of claim 13, wherein the at least one progressive jackpot includes an award of a number of free spins.

16. The machine-readable non-transitory storage media of claim 15, wherein the first increment amount includes a fraction of a free spin.

17. The machine-readable non-transitory storage media of claim 13, wherein the first time amount equals N seconds.

18. The machine-readable non-transitory storage media of claim 17, wherein X is less than or equal to N.

* * * * *